US009612028B2

(12) United States Patent
Chua

(10) Patent No.: US 9,612,028 B2
(45) Date of Patent: Apr. 4, 2017

(54) AIR CHECK VALVE SYSTEM AND METHOD OF MOUNTING SAME

(75) Inventor: Bun-Hiong Chua, Mishawaka, IN (US)

(73) Assignee: CTB, Inc., Milford, IN (US)

( * ) Notice: Subject to any disclaimer, the term of this patent is extended or adjusted under 35 U.S.C. 154(b) by 372 days.

(21) Appl. No.: 13/006,551

(22) Filed: Jan. 14, 2011

(65) Prior Publication Data

US 2011/0183600 A1 Jul. 28, 2011

Related U.S. Application Data

(60) Provisional application No. 61/298,420, filed on Jan. 26, 2010.

(51) Int. Cl.

| | |
|---|---|
| ***F24F 7/00*** | (2006.01) |
| ***F24F 13/08*** | (2006.01) |
| ***F24F 7/06*** | (2006.01) |
| ***F24F 13/14*** | (2006.01) |

(52) U.S. Cl.

CPC ..... *F24F 7/06* (2013.01); *F24F 13/1413* (2013.01)

(58) Field of Classification Search

USPC ..... 454/180, 181, 259, 338, 353, 352, 358

See application file for complete search history.

(56) References Cited

U.S. PATENT DOCUMENTS

| | | | | |
|---|---|---|---|---|
| 2,055,592 A | | 9/1936 | Roed | |
| 2,489,446 A | | 11/1949 | Biancani | |
| 2,541,665 A | * | 2/1951 | Prudhon | 415/146 |
| 2,638,836 A | * | 5/1953 | Hull | 454/344 |
| 2,687,687 A | * | 8/1954 | Prudhon | 454/351 |
| 2,912,920 A | | 11/1959 | Coe | |
| 2,924,166 A | | 2/1960 | Gerlitz | |
| 2,955,523 A | * | 10/1960 | Rasch | 454/179 |
| 3,308,744 A | | 3/1967 | Schach | |
| 3,334,569 A | * | 8/1967 | Lambie | 454/352 |
| 3,895,650 A | | 7/1975 | Cadiou | |
| 3,912,473 A | * | 10/1975 | Wilkins | 55/501 |
| 3,921,900 A | * | 11/1975 | Cole | 236/93 R |
| 4,094,336 A | * | 6/1978 | Urschel et al. | 137/512.1 |
| 4,114,805 A | * | 9/1978 | Humphreys et al. | 236/1 G |
| 4,146,048 A | * | 3/1979 | McCabe | 137/75 |

(Continued)

FOREIGN PATENT DOCUMENTS

| | | | |
|---|---|---|---|
| CH | 130232 A | * | 11/1928 |
| CH | 130232 A | * | 11/1928 |

OTHER PUBLICATIONS

Airlanco; http://www.airlanco.com/Airauger Dry Storage Aeration/Unloading Systems; © 2006A AIRLANCO Brochure.

(Continued)

*Primary Examiner* — Steven B McAllister
*Assistant Examiner* — Jonathan Cotov
(74) *Attorney, Agent, or Firm* — Harness, Dickey

(57) ABSTRACT

An air check valve system configured to be mounted for fluid communication with a fan can include a ring having a generally circular inner diameter that defines an air passage through a plane of the ring. A first and a second flange can extend from the ring. A rod can have a first end mounted to the first flange and a second end mounted to the second flange. The rod can define a pivot axis. A first and a second damper plate can be mounted to the rod for rotation around the pivot axis between an open and a closed position.

15 Claims, 6 Drawing Sheets

(56) References Cited

U.S. PATENT DOCUMENTS

| | | | | | |
|---|---|---|---|---|---|
| 4,306,490 | A | * | 12/1981 | Kallestad et al. | 454/182 |
| 4,313,456 | A | * | 2/1982 | Thomas | 137/269 |
| 4,336,749 | A | * | 6/1982 | Barnhart et al. | 454/349 |
| 4,353,680 | A | | 10/1982 | Hiraoka et al. | |
| 4,372,196 | A | | 2/1983 | Henderson | |
| 4,406,216 | A | * | 9/1983 | Hott et al. | 454/349 |
| 4,445,426 | A | * | 5/1984 | Bohanon, Sr. | 454/351 |
| 4,474,167 | A | * | 10/1984 | McCabe | 126/287.5 |
| 4,594,940 | A | | 6/1986 | Wolbrink et al. | |
| RE32,362 | E | * | 2/1987 | McCabe | 137/15.25 |
| 4,779,518 | A | * | 10/1988 | Artwick et al. | 454/353 |
| 4,872,398 | A | * | 10/1989 | Shen | 454/346 |
| 4,986,469 | A | | 1/1991 | Sutton, Jr. | |
| 5,236,391 | A | | 8/1993 | Schaefer | |
| 5,336,131 | A | | 8/1994 | Crider et al. | |
| 5,535,804 | A | | 7/1996 | Guest | |
| 5,538,074 | A | | 7/1996 | Meyer | |
| 5,567,200 | A | * | 10/1996 | Swartzendruber | 454/338 |
| 5,575,622 | A | * | 11/1996 | Zimmerman et al. | 415/213.1 |
| 5,695,116 | A | * | 12/1997 | Karabin | 236/1 G |
| 5,890,959 | A | * | 4/1999 | Pettit et al. | 454/184 |
| 5,924,922 | A | * | 7/1999 | Eakin et al. | 454/256 |
| 6,203,423 | B1 | * | 3/2001 | Craw et al. | 454/359 |
| 6,378,322 | B1 | | 4/2002 | Calvert | |
| 6,386,828 | B1 | | 5/2002 | Davis et al. | |
| 6,616,404 | B1 | * | 9/2003 | Davis et al. | 415/147 |
| 6,685,557 | B1 | * | 2/2004 | Hoffe | 454/259 |
| 6,837,785 | B2 | * | 1/2005 | Soderlund | 454/184 |
| 6,953,320 | B1 | * | 10/2005 | Davis et al. | 415/147 |
| 7,070,385 | B2 | * | 7/2006 | Milana | 415/25 |
| 7,611,403 | B2 | * | 11/2009 | Wenger | 454/338 |
| 2003/0060155 | A1 | | 3/2003 | Baumgartner et al. | |
| 2004/0129410 | A1 | * | 7/2004 | Soderlund | 165/120 |
| 2006/0286924 | A1 | * | 12/2006 | Milana | 454/259 |
| 2007/0165374 | A1 | * | 7/2007 | Chen et al. | 361/687 |
| 2009/0023378 | A1 | * | 1/2009 | Hansen et al. | 454/259 |
| 2011/0028080 | A1 | * | 2/2011 | Hopkins et al. | 454/259 |
| 2011/0028081 | A1 | * | 2/2011 | Hopkins et al. | 454/259 |
| 2012/0149294 | A1 | * | 6/2012 | Labrecque | 454/353 |

OTHER PUBLICATIONS

Sukup Manufacturing Co.; www.sukup.com; Sukup Axial Fans brochure; L1101-O3201OG; © 2010 Sukup Manufacturing Co.
Caldwell Grain Conditioning Systems; Chief Agri/Industrial Division; www.agri.chiefind.com (unknown date).
Brock Grain Systems; Entrance Collar Damper Assembly Instructions; MGB1353A; Aug. 1996.
Brock Grain Systems; Brock® Transitions and Entrance Collars; Transition Assemblies; pp. 12-13; MFH1934B (unknown date).
Chore-Time Equipment, "48" and 52" Hyflo™ Fans Installation and Operators Instructions Manual", Jul. 2003.
Kolowa 1 Brochure, available at least by Mar. 6, 2004.
Kolowa 2 Brochure, available at least by Mar. 6, 2004.
DEL-AIR Systems, Northwind Fans, Mar. 1999.

* cited by examiner

AIR CHECK VALVE SYSTEM AND METHOD OF MOUNTING SAME

CROSS-REFERENCE TO RELATED APPLICATIONS

This application claims the benefit and priority of U.S. Provisional Application No. 61/298,420, filed Jan. 26, 2010. The entire disclosure of the above application is incorporated herein by reference.

FIELD

The present teachings relate to ventilation systems, and particularly to an air check valve system for fans operable to be mounted in structures.

BACKGROUND

This section provides background information related to the present disclosure which is not necessarily prior art.

Various structures, such as grain bins or farmhouses, may use ventilation systems to maintain a selected environment. The ventilations systems can ensure that a supply of fresh air and acceptable levels of various materials are maintained within the structure. For example, a ventilation system can assist in removing less desirable compounds, such as carbon dioxide emitted by livestock within a farmhouse or moisture from grain within a grain bin. Therefore, the ventilation system may be used to move volumes of air and may generally include various fan systems to move the air.

Grain bins may be any appropriate housing configured for grain storage. Grain bins can be generally round structures that include a raised floor creating an air plenum beneath the grain. The floor can be perforated so that air can pass from the plenum through the floor and grain to remove moisture from the grain. Multiple fans can be arranged around the grain bin to push air into the air plenum.

In a ventilation system for a grain bin that includes two or more fans back pressure can be created by an operating fan. This can result in air flow toward a non-operating fan, causing its propellers to turn in the opposite (i.e., reverse of normal) direction. Thus, the motor needs additional power to overcome the load caused by such backflow from other fans that may be already on, which can cause the fan motor to experience overload or over-current. Therefore, it is desirable to inhibit strong backflow air through the fans that are otherwise in the deactivated or "off" position.

Moreover, in such ventilation systems it is desirable to minimize or eliminate moving components that may tend to cease, clog, stick or otherwise inhibit smooth operation. Furthermore, in some instances it may be desirable to retrofit existing ventilation systems to incorporate various ventilation components, such as dampers and the like. In such circumstances, it may be desirable to add such supplemental components without requiring additional space around the existing components and/or mounting hardware.

SUMMARY

This section provides a general summary of the disclosure, and is not a comprehensive disclosure of its full scope or all of its features.

An air check valve system configured to be mounted for fluid communication with a fan can include a ring having a generally circular inner diameter that defines an air passage through a plane of the ring. A first and a second flange can extend from the ring. A rod can have a first end mounted to the first flange and a second end mounted to the second flange. The rod can define a pivot axis. A first and a second damper plate can be mounted to the rod for rotation around the pivot axis between an open and a closed position. The pivot axis of the rod can define a non-parallel angle with the plane of the ring, such that the first and second damper plates are influenced by gravity to locate at the closed position when the fan is in a deactivated state and air flow generated by the fan in an activated state urges the damper plates into the open position.

According to additional features, the first flange can define a first flange mounting aperture that is located at a first distance from the ring. The second flange can define a second mounting aperture that is located at a second distance from the ring. The second distance can be greater than the first distance. A third and a fourth flange can extend from the ring. The third and fourth flanges can have stops that extend therefrom and are adapted to engage the first and second dampers, respectively, when the first and second dampers are located in the closed position.

According to still other features, a first volume of air is urged through the air passage in the open position and a second volume of air is permitted to flow through the air passage when the first and second dampers are in the closed position. The second volume of air is non-zero and less than the first volume of air. The first and second flanges can be diametrically opposed. The third and fourth flanges can also be diametrically opposed. The ring can be adapted to be mounted relative to the fan, such that the second flange is closest to ground relative to the first, third and fourth flanges. In one example, the first and second flanges both have a generally semicircular shape.

A method of mounting an air check valve relative to a transition duct and a fan can include, disconnecting a fan collar extending from the fan from a transition duct collar extending from a transition duct. An outer ring of the check valve can be positioned between the fan collar and the transition duct collar. The air check valve can have a first and a second damper plate that are both rotatably mounted around a rod at a non-parallel angle relative to a plane of the ring. The outer ring can be coupled between the fan collar and the transition duct collar, such that the first and second damper plates are influenced by gravity to locate at a closed position when the fan is in a deactivated state and wherein airflow generated by the fan in an activated states urges the damper plates into an open position.

According to additional features, positioning the outer rod can include orienting the rod in a generally upright position relative to ground. Disconnecting the fan collar from the transition duct collar can comprise removing fasteners that extend through respective apertures formed through the fan collar and the transition duct collar. Positioning the outer ring of the air check valve can include aligning ring apertures formed through the ring with the apertures formed through the fan collar and the transition duct collar. According to one example, coupling the outer ring can comprise locating fasteners through axially aligned apertures of the fan collar, ring and transition duct collar. The respective fasteners can then be threadably advanced into a secure position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
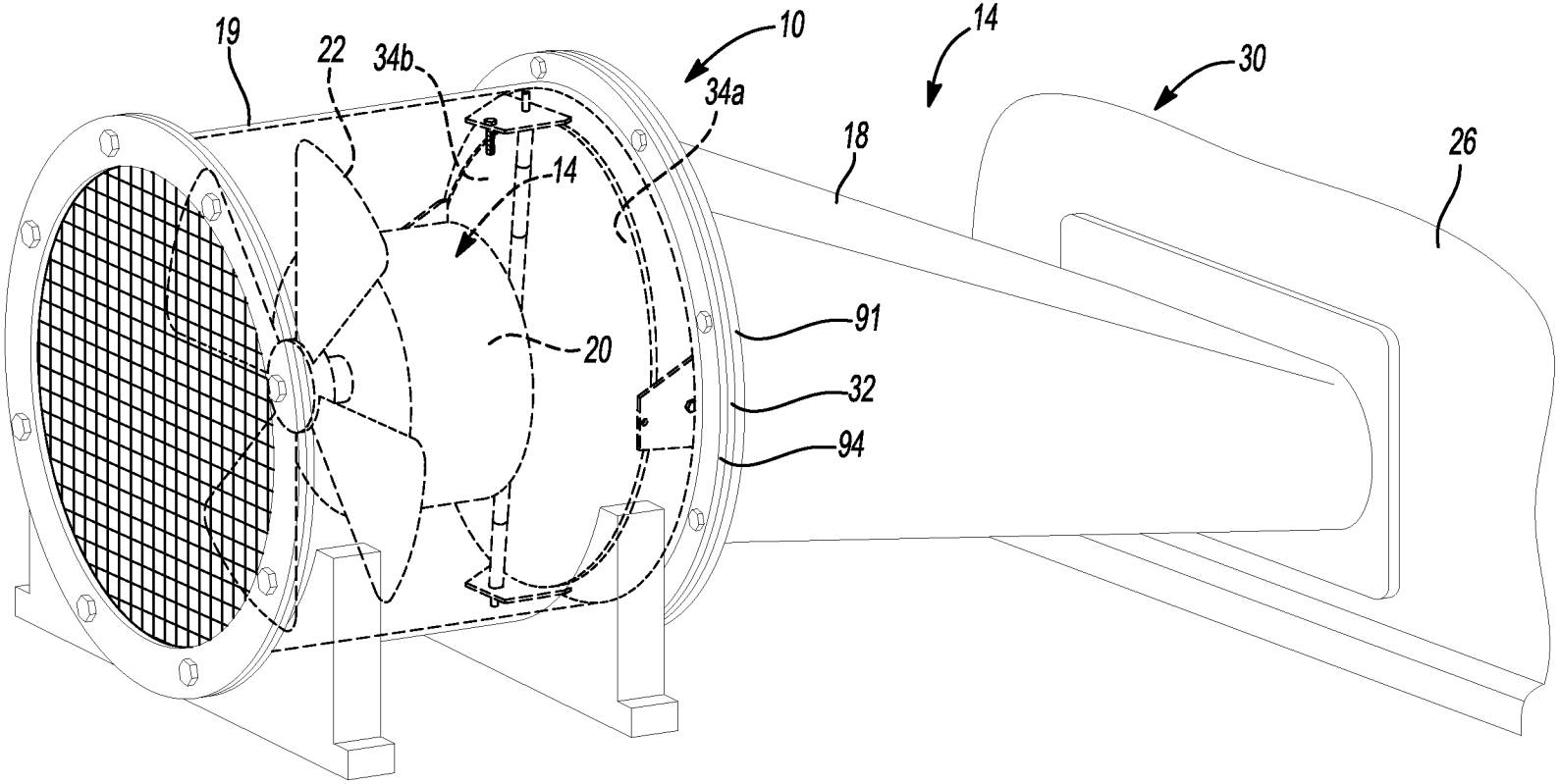
FIG. 1 is a side perspective view of an aeration system having an air check valve system according to the present teachings and mounted between a fan and a transition duct that is attached to an exemplary grain bin.
Figure 2:
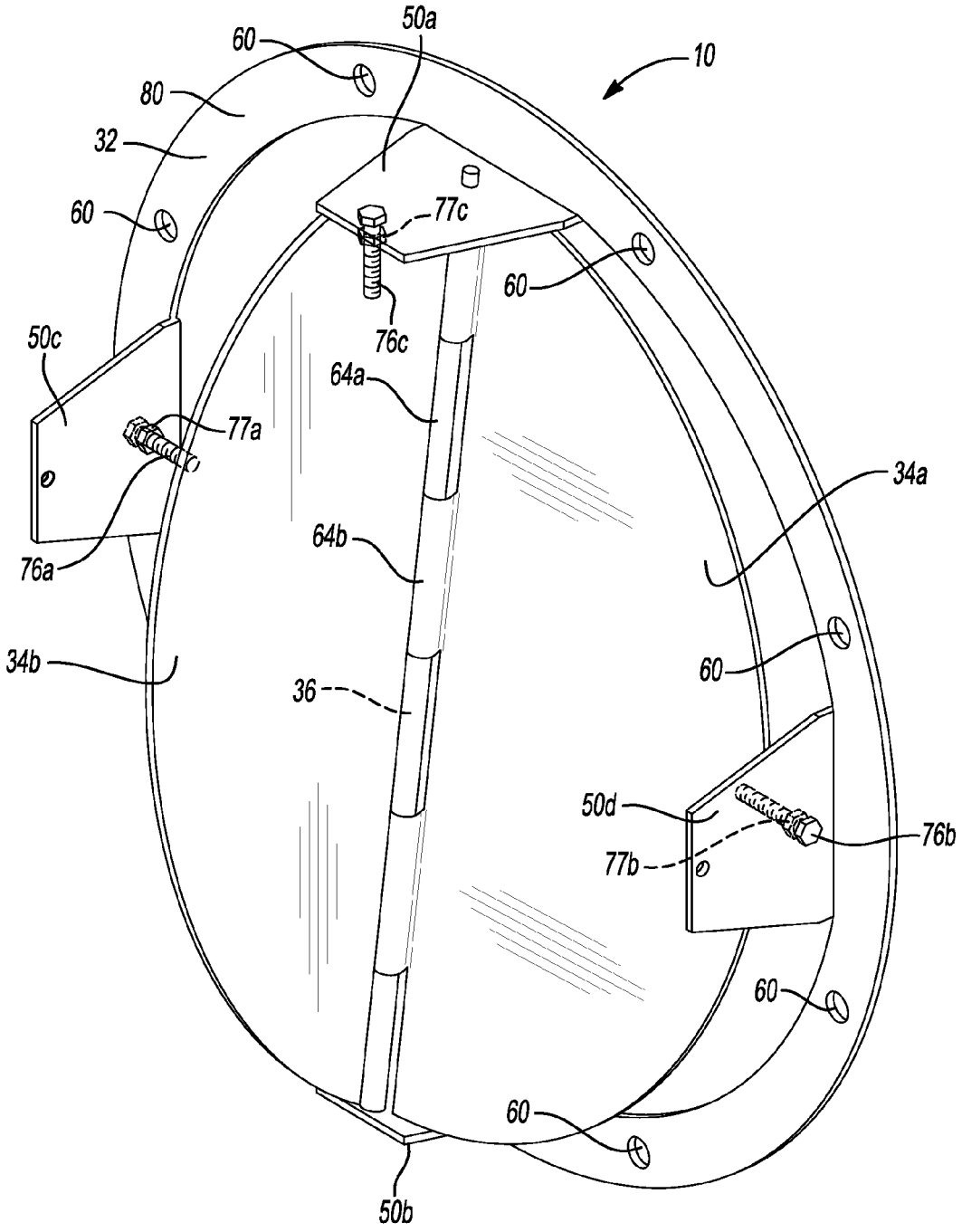
FIG. 2 is a side perspective view of the air check valve system of FIG. 1.

With initial reference now to FIGS. 1 and 2, an air check valve system constructed as one example of an air check valve system in accordance with the present teachings is shown and generally identified at reference numeral 10. The air check valve system 10 is illustrated operatively assembled as part of an aeration system 12 for a grain bin 30. The air check valve system 10 can be mounted between a fan assembly 14 and a transition duct 18. The fan assembly 14 can generally include a fan housing 19 that includes a fan motor 20 that rotationally drives a fan blade 22. While the fan assembly 14 can be an axial fan as illustrated. Other configurations are contemplated. The transition duct 18 can generally take the shape of a cylindrical or oval cross-section that fluidly connects the fan housing with an enclosure wall 26 of an enclosure 30. In the particular example shown, the enclosure 30 is depicted as a grain bin although it is contemplated that the air check valve system 10 is operable for connection to other enclosures such as farmhouses. Furthermore, it will be appreciated that while only one fan assembly 14 is illustrated as communicating with the grain bin 30, two or more fan assemblies 14 (e.g. identical to that illustrated in FIG. 1) can be arranged around the grain bin 30 for communication with an air plenum of the grain bin 30.

In general, the air check valve system 10 can be utilized in such a grain bin such as the grain bin 30 where multiple aeration fans are communicating air into or out of the grain bin 30. The air check valve system 10 can minimize the potential for motor overload in instances where back flow from the remaining fans may otherwise be causing the fan blade 22 to be rotating in an opposite (reverse) direction. Furthermore, the air check valve system 10 can be useful to minimize air leakage from the other fans when full aeration power is unnecessary. In particular, the air check valve system 10 can allow a user to decide how many fan assemblies 14 may be necessary to turn on for a given application. As will be described, the air check valve system can be specifically configured as an accessory add-on system to a current axial fan transition. The air check valve system 10 is specifically arranged to allow semicircular shaped damper plates to close automatically and limit the volume of back flow air passing through it when the other fans connected to the grain bin 30 are turned on.

Figure 3:
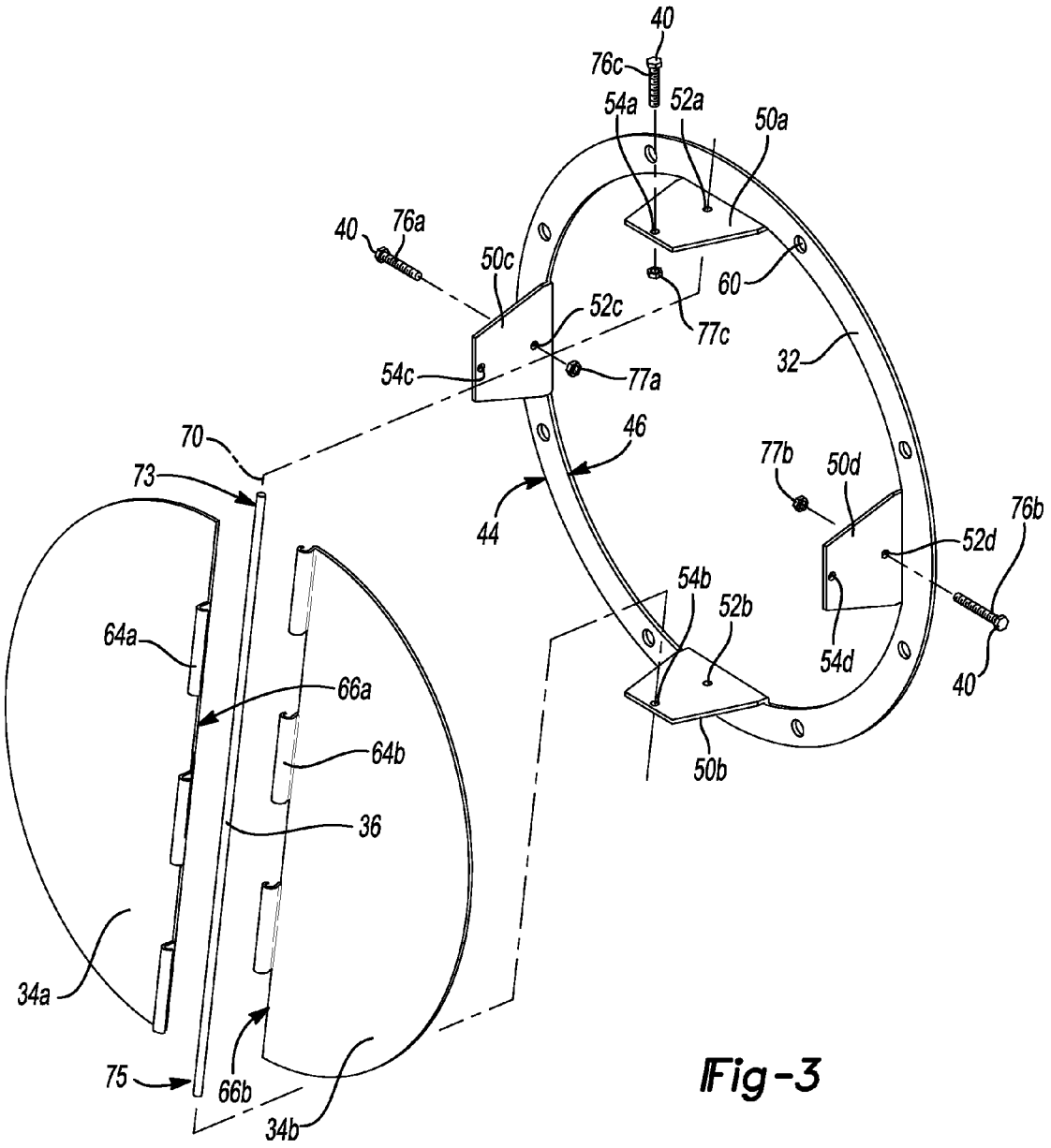
FIG. 3 is an exploded view of the air check valve system of FIG. 2.

With continued reference now to FIG. 2 and additional reference to FIG. 3, the air check valve system 10 will be described in greater detail. The air check valve system 10 can include an outer, annular, substantially flat, ring 32, a pair of damper plates 34*a* and 34*b*, a pivot rod 36 and three stops 40. The ring 32 can be of a circular annular shape having an outer perimeter 44 and an inner perimeter 46. A series of flanges 50*a*, 50*b*, 50*c* and 50*d* can extend from the inner perimeter 46 of the ring 32. In one example, the flanges 50*a*-50*d* can be integrally formed or monolithic with the ring 32. The ring 32 can be formed of a rigid material, such as metal including, but not limited to, stainless steel, steel and aluminum. As in the illustrated example, the flanges 50*a*-50*d* can each be formed having the same shape. For purposes of the following discussion the flange 50*a* will be referred to as an upper flange, the flange 50*b* will be referred to as the lower flange and the flanges 50*c* and 50*d* will be referred to as side flanges. The terms "upper" and "lower" are denoted to establish the mounting locations of the respective flanges in relation to ground. Each of the flanges 50*a*-50*d* can define an inner aperture 52*a*-52*d* and an outer aperture 54*a*-54*d*. The upper and lower flanges 50*a* and 50*b* can be diametrically opposed and the side flanges 50*c* and 50*d* can be diametrically opposed. The ring 32 also can define a plurality of adapter ring mounting apertures 60 formed therearound.

The damper plates 34*a* and 34*b* can each take the form of a semicircular shape, creating a butterfly valve. Both of the damper plates 34*a* and 34*b* can include hinge members 64*a* and 64*b* arranged on central lateral edges 66*a* and 66*b* of the respective damper plates 34*a* and 34*b*. The pivot rod 36 can define a pivot axis 70 and have a first (upper) end 73 and a second (lower) end 75. The stops 40 can include a pair of side stops 76*a* and 76*b* as well as an upper stop 76*c*.

Figure 4A:
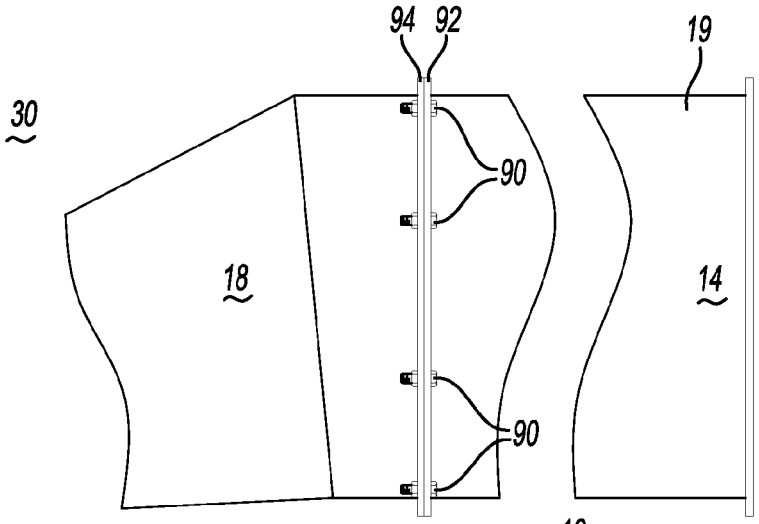
FIGS. 4A-4C illustrates an exemplary installation sequence where a fan is initially disconnected from a transition duct, the air check valve system coupled to the transition duct and the fan coupled back to the transition duct, thereby capturing the air check valve system between the transition duct and the fan.

With specific reference now to FIG. 2, the exemplary air check valve system 10 is shown in an assembled configuration. As illustrated, the hinge members 64*a* and 64*b* of the respective damper plates 34*a* and 34*b* are mounted on the pivot rod 36 for rotational movement. Notably, in this example the upper end 73 of the pivot rod 36 is mounted through the inner aperture 52*a* of the upper flange 50*a* while the lower end 75 of the pivot rod 36 is mounted through the outer aperture 54*b* of the lower flange 50*b*. In this way, the upper end 73 of the pivot rod 36 is mounted closer to the ring 32 than the lower end 75 of the pivot rod 36. The pivot rod 36 can have a length sufficient to extend through apertures 52*a* and 54*b* and be secured in place. The rod 36 can be designed with a specific length to allow the fan transition duct 18 to capture the pivot rod 36 and hold the respective damper plates 34*a* and 34*b* (FIG. 4A). In other words the ends of the rod 36 can contact the interior surface of the fan transition duct 18 or other duct into which it is mounted, thereby retaining the rod 36 within the apertures 52*a* and 54*b*. Therefore, no hardware is needed. As illustrated, the rod 36 can be position against the interior surface of a constant diameter portion of the transition collar 18. In another embodiment (not shown) ends of the pivot rod 36 can be threaded and a cooperating nut at each end can be used to hold the pivot rod 36 in place. An upper stop 76*c* is shown mounted into the outer aperture 54*a* of the upper flange 50*a*. The upper stop 76*c* can have a nut 77*c* advanced thereon. Side stops 76*a* and 76*b* are shown mounted into the inner aperture 52*c* of the side flange 50*c* and the inner aperture 52*d* of the side flange 50*d*, respectively. The side stops 76*a* and 76*b* can have nuts 77*a* and 77*b*, respectively advanced thereon.

As noted above, the pivot rod 36 can be mounted such that the pivot axis 70 is defined at a non-parallel angle relative to a plane 80 defined by the ring 32. In addition, the air check valve system 10 can be mounted such that the plane 80 can be oriented substantially vertically. In this or other cases, the pivot rod 36 can be mounted such that the pivot axis 70 is defined at a non-parallel angle relative to both a vertical plane, and a horizontal plane. The angle of the pivot axis 70 (relative to plane 80, to a vertical plane, or to both) as described above can be selected based upon the specific needs of a particular installation. In one example, the $g_x$ force can be at least the minimum force to overcome internal friction force due to connections of the pivot rod 36, and the damper plates 34*a* and 34*b*. The maximum $g_x$ can also greatly depend on the fan sizes. In some instances, this angle (e.g., θ or angle 96) can be between about five degrees and about sixty degrees, or in other instances between about five and about thirty degrees, or in still other instances, between about 5 degrees and about 15 degrees, or at about 7.25 degrees. This 7.25 degree angle may, for example, work well with the fans manufactured by CTB, Inc. and marketed under the name Brock® (as non-limiting examples).

Figure 6:
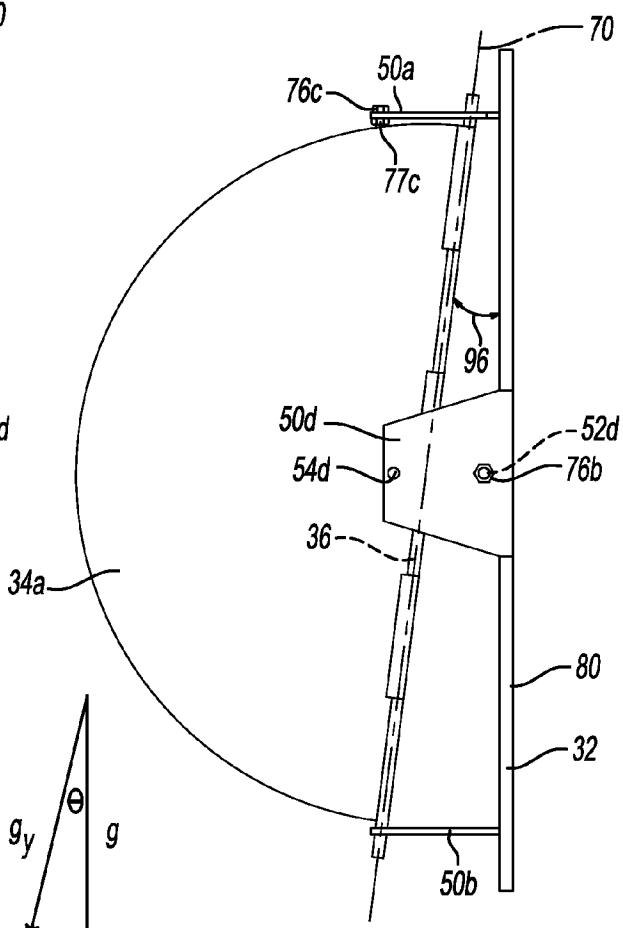
FIG. 6 is a side view of the air check valve system of FIG. 2 and shown with a pair of semicircular damper plates in an open position.

As shown in FIG. 6, the angled orientation of pivot axis 70 results in the downward force of gravity g acting on each of the damper plates 34*a* and 34*b* in two components $g_x$ and $g_y$. Both these component forces are shown perpendicular relative to each other, whereby the force $g_x$ is parallel to the pivot axis 70. The gravity force component $g_x$ operates on the damper plates 34*a* and 34*b* in the $g_x$ direction which can tend to move them toward a closed position. Since gravity force component $g_y$ is parallel to the pivot axis 70, it does not directly influence the movement of the damper plates 34*a* and 34*b*.

Figure 7:
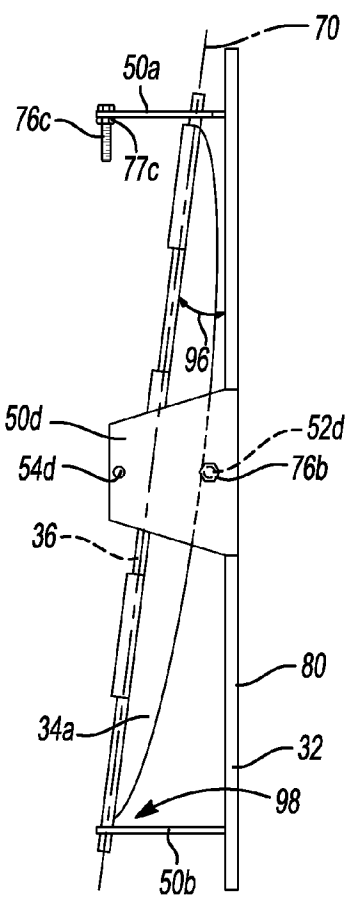
FIG. 7 is a side view of the air check valve system shown in FIG. 6 and with the damper plates in a closed position.
Figure 8:
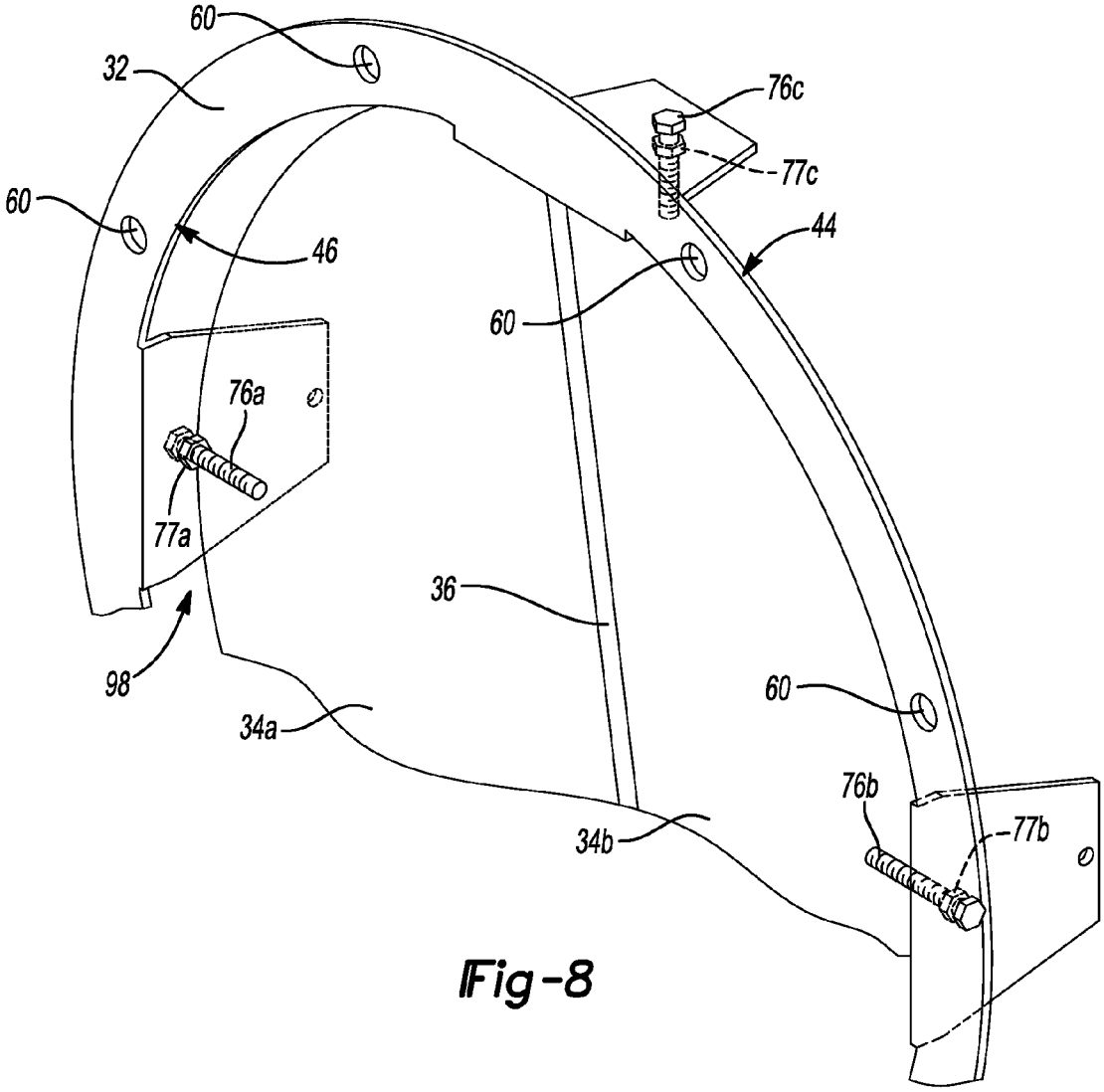
FIG. 8 is a partial rear perspective view of the air check valve system illustrating a pair of stoppers that are configured to limit rotational movement of the damper plates in the closed position.

Briefly, during operation of the fan assembly 14, when the fan blade 22 is being driven by the motor 20 (i.e., "activated"), air is urged through the inner perimeter 46 of the ring 32 causing the damper plates 34*a* and 34*b* to be rotated toward each other (see also FIGS. 6 and 8). The upper stop 76*c* will preclude the damper plates 34*a* and 34*b* from over-rotating or rotating generally more than 90 degrees from the closed position (see also FIG. 7). More specifically, the damper plates 34*a* and/or 34*b* can engage the upper stop 76*c* to limit over rotation. During movement of the damper plates 34*a* and 34*b* from a closed position to an open position, gravity force component $g_x$ is overcome. Since gravity force component $g_y$ does not need to be overcome during such movement, the damper plates 34*a* and 34*b* can be easily moved to an open position. In certain instances, the activated fan 14 is able to open the damper plates 34*a* and 34*b* with negligible static pressure losses. In other words, any resulting static pressure losses can be so small that they have essentially no impact on the overall efficiency of the ventilation system.

When the fan blade 22 is not being driven by the motor 20 (i.e., "deactivated") the gravity force component $g_x$ can tend to move the damper plates 34*a* and 34*b* toward a closed position (see, e.g., FIGS. 2 and 7). Thus, the air check valve system 10 does not require any supplemental mechanism (e.g., such as a return spring) to urge the damper plates 34*a* and 34*b* to the closed position increasing reliability and reducing potential maintenance expenses. In the closed position, the damper plates 34*a* and 34*b* can be configured to engage the side stops 76*a* and 76*b*, respectively, to prevent further rotation.

Another force that can tend to move the damper plates 34*a* and 34*b* toward a closed position relates to stop 76*c*. Stop 76*c* can maintain the damper plates 34*a* and 34*b* in a "V" configuration that opens downstream, when they are in an open position. Thus, in the case where the illustrated fan assembly 14 is deactivated and experiencing backflow, for example, caused by additional activated fan assemblies 14 communicating with the grain bin 30, this backflow impinges on the damper plates 34*a* and 34*b* in their open "V" configuration creating a force tending to move the damper plates 34*a* and 34*b* toward a closed position. In certain instances, it can be the combination of this backflow force and the gravity force component that together moves the damper plates 34*a* and 34*b* into a closed position.

Figure 4B:
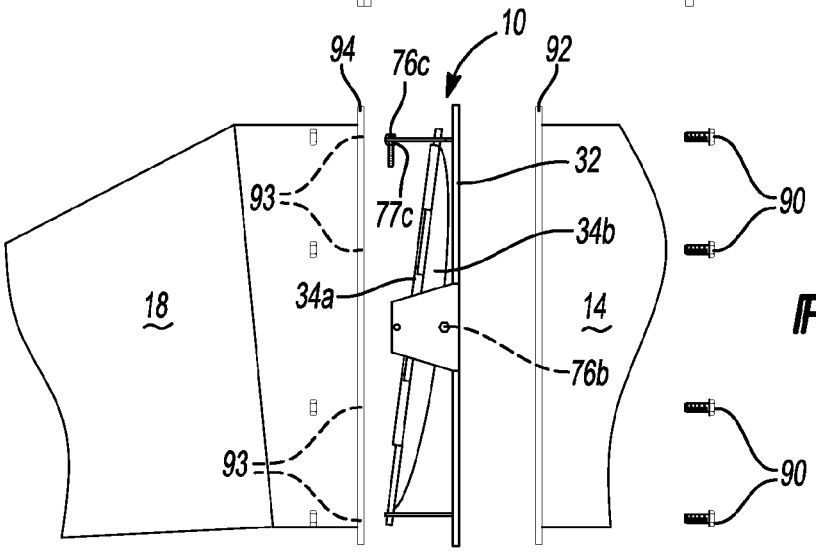
Figure 4C:
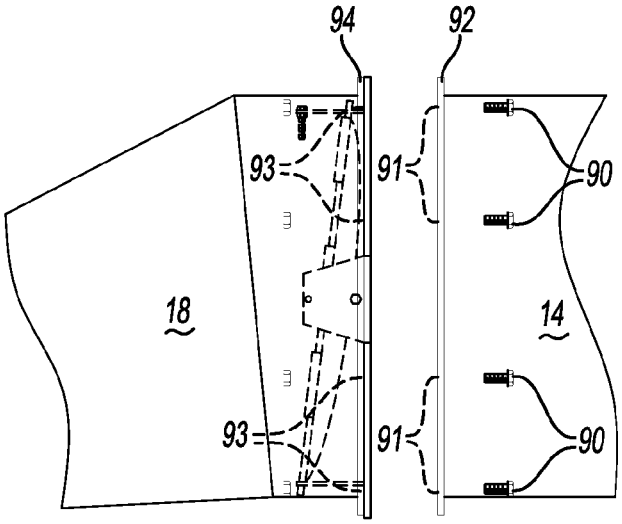

With reference now to FIGS. 4A-4D, an exemplary sequence for installing the air check valve system 10 will be described. Again, the air check valve system 10 can be particularly useful for mounting relative to an existing fan assembly 14 that is already coupled to a grain bin 30 by way of a transition duct 18. At the outset, a user can remove any fastening hardware 90 that are securably attached to a fan collar 92 of the fan housing 19 and a transition duct collar 94 of the transition duct 18. The hardware 90 can comprise a collection of nuts and bolts for example. However, any suitable attachment hardware may be employed. Once the hardware 90 has been removed from fan collar apertures 91 of the respective fan collar 92 and transition duct apertures 93 of the transition duct collar 94, the fan assembly 14 can be moved away from the transition duct as illustrated in FIG. 4B.

Next, the air check valve system 10 can be placed onto the newly exposed transition duct collar 94. Notably, the flange (i.e., the upper flange 50*a*) having the pivot rod 36 secured through its inner aperture (i.e., 52*a*, FIG. 3) is mounted towards an upper end (away from the ground) of the transition duct 18. Consequently, the flange (i.e., the lower flange 50*b*) having the pivot rod 36 mounted through its outer aperture 54*b* (FIG. 3) is arranged near a bottom end of the transition duct 18 (closest to ground). At this point, the fan collar 92 can be moved against the ring 32 of the air check valve system 10. Fasteners such as the fasteners 90 can then be advanced through the fan collar apertures 91, the adapter ring mounting apertures 60 and the transition duct collar apertures 93. Thus, the substantially flat ring 32 can be sandwiched between fan collar 92 and transition duct collar 94, thereby providing the only portion of the air check valve system 10 visible from the exterior of the aeration system 12. The substantially flat ring 32 has a thinness that can enable there to be no positional change to any existing mountings (e.g., 97) supporting the fan assembly 14, the transition duct 18, or both. Similarly, the exemplary mounting method described can be accomplished without requiring any changes or modifications to an existing fan assembly 14 or transition duct 18.

Figure 5:
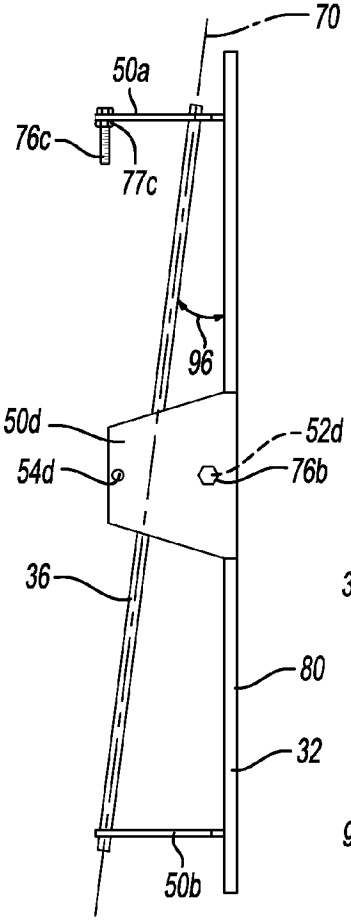
FIG. 5 is a side view of an adapter ring and a pivot rod of the air check valve system of FIG. 2.

With reference now to FIGS. 5-8, the operation of the air check valve system 10 will be further described. As illustrated in FIG. 5, the pivot rod 36 is mounted such that it defines an angle 96 relative to the plane 80 of the ring 32. The angle 96 can be any suitable angle, such that the mass of the damper plates 34*a* and 34*b* can influence rotation around the pivot rod 36 to the closed position (FIG. 7) when the fan motor 20 is off. In general, when the fan motor 20 is turned off, the air check valve system 10 can be specifically designed to be automatically self-closing using gravity force component $g_x$ as illustrated in FIG. 6. As mentioned above, gravity force component $g_x$ acting on the damper plates 34*a* and 34*b* can be supplemented by a force that can be generated from backflow air impinging on the downstream face of the damper plates 34*a* and 34*b* that can be created when other fans connected to the grain bin 30 are turned on ("activated").

As illustrated in FIG. 8, a small air gap 98 still exists around the outer peripheral edges of the damper plates 34*a* and 34*b* when the damper plates 34*a* and 34*b* are in the closed position. The small gap 98 can permit a reduced volume of air to flow through the inner perimeter 46 of the ring 32. Depending upon the configuration, this gap 98 can have a minimum cross-sectional area defined by the space between the peripheral edges of the closed damper plates 34*a* and 34*b* and the ring 32. In many other instances, this gap 98 can have a minimum cross-sectional area defined by the space between the outer peripheral edges of the closed damper plates 34*a* and 34*b* and the adjacent inner surface of the transition duct. This minimal cross-sectional area of the gap 98 limits the small volume of air which is permitted to flow through the small gap 98. Thus, the minimal cross-sectional area of the gap 98 can be smaller than that required to permit backpressure in the ventilation system 12 from generating enough airflow through the gap to impart counter-rotation to the blades 22 of fan 14 when the fan motor 20 is in an deactivated (inactive) state. In some cases, the minimal cross-sectional area of the gap 98 can be no more than about twenty percent of the cross-sectional area of the transition duct at its collar 94, and in other cases no more than around five percent of such area.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. As but a few non-limiting examples, the hinge between the damper plates could be formed as a living hinge (which can have a tendency to move the damper plates toward a closed position), or the stops could be provided by bending the flanges inwardly (rather than providing pins extending from the flanges). Countless other variations are possible and such variations are not to be regarded as a departure from the disclosure, and all such modifications are intended to be included within the scope of the disclosure.

What is claimed is:

1. An air check valve system configured to be mounted for fluid communication with a fan, the air check valve system comprising:

a ring having a generally circular inner diameter that defines an air passage through a plane of the ring;

a first and a second flange that extend from the ring;

a rod having a first end mounted to the first flange and a second end mounted to the second flange, the rod defining a common pivot axis;

a first and a second damper plate that are mounted to the rod for rotation around the common pivot axis between an open and a closed position, wherein the first and second damper plates share the common pivot axis of rotation; and first and second stops engaging the first and second dampers, respectively, when the first and second dampers are located in the closed position;

wherein the pivot axis of the rod defines a non-parallel angle with the plane of the ring such that the first and second damper plates are influenced by gravity to locate at the closed position when the fan is in a deactivated state and airflow generated by the fan in an activated state urges the damper plates into the open position; and wherein a first volume of air is urged through the air passage in the open position and a second volume of air is permitted to flow through the air passage when the first and second dampers are in the closed position, and the second volume of air is non-zero and less than the first volume of air.

2. The air check valve system of claim 1 wherein the first flange defines a first flange mounting aperture located at a first distance from the ring and the second flange defines a second mounting aperture located at a second distance from the ring, the second distance being greater than the first distance.

3. The air check valve of claim 2, further comprising a third and a fourth flange that extend from the ring, and the first and second stops extending from the third and fourth flanges respectively.

4. The air check valve of claim 3 wherein the third and fourth flanges are diametrically opposed and the first and second flanges are diametrically opposed.

5. The air check valve of claim 4 wherein the ring is adapted to be mounted relative to the fan such that the second flange is lower than the first, third and fourth flanges.

6. The air check valve of claim 1 wherein the first and second flanges both have a generally semicircular shape.

7. A method of mounting an air check valve relative to a transition duct and a fan, the method comprising:

disconnecting a fan collar extending from the fan from a transition duct collar extending from the transition duct;

positioning an outer ring of the air check valve between the fan collar and the transition duct collar, the air check valve having a first and a second damper plate that are rotatably mounted around a rod at a non-parallel angle relative to a plane of the outer ring, wherein the first and second damper plates share a common axis of rotation around a common pivot axis defined by the rod; and coupling the outer ring between the fan collar and the transition duct collar such that the first and second damper plates are influenced by gravity to locate at a closed position when the fan is in a deactivated state and wherein airflow generated by the fan in an activated state urges the damper plates into an open position; and orienting the rod in a generally upright position relative to ground with an upper portion of the rod located closer to the outer ring than a lower portion of the rod;

wherein each of the fan collar, the transition duct collar, and the outer ring comprises a flat annular flange, and wherein coupling the outer ring between the fan collar and the transition collar further comprises positioning each of the fan collar and the transition collar in a position substantially corresponding to a pre-disconnecting position of the respective fan collar and transition collar.

8. The method of claim 7 wherein disconnecting the fan collar from the transition duct collar comprises:

removing fasteners that extend through respective apertures formed through the fan collar and the transition duct collar.

9. The method of claim 8 wherein positioning the outer ring of the air check valve comprises:

aligning ring apertures formed through the ring with the apertures formed through the fan collar and the transition duct collar.

10. The method of claim 9 wherein coupling the outer ring comprises:

locating fasteners through axially aligned apertures of the fan collar, ring and transition duct collar; and threadably advancing the respective fasteners into a secure position.

11. An air check valve system configured to be mounted for fluid communication with a fan, the air check valve system comprising:

a ring having a generally circular inner diameter that defines an air passage through a plane of the ring;

a first and a second flange that extend in a diametrically opposed relationship from the ring, wherein the first flange defines a first flange mounting aperture located at a first distance from the ring and the second flange defines a second mounting aperture located at a second distance from the ring, the second distance being greater than the first distance;

a rod defining a common pivot axis and having a first end positioned through the first flange mounting aperture and a second end positioned through the second flange mounting aperture;

a first and a second semi-circular damper plate that are each mounted around the rod for rotation between an open and a closed position around the common pivot axis of the rod; and first and second stops engaging the first and second dampers, respectively, when the first and second dampers are located in the closed position;

wherein the second flange mounting aperture is located further away from the plane of the ring compared to the first flange mounting aperture such that the first and second damper plates are influenced by gravity to locate at the closed position when the fan is in a deactivated state and airflow generated by the fan in an activated state urges the damper plates into the open position; and wherein a first volume of air is urged through the air passage in the open position and a second volume of air is permitted to flow through the air passage when the first and second dampers are in the closed position, and the second volume of air is non-zero and less than the first volume of air.

12. The air check valve of claim 11, further comprising a third and a fourth flange that extend from the ring, and the first and second stops extending from the third and fourth flanges, respectively.

13. The air check valve of claim 12 wherein the third and fourth flanges are diametrically opposed.

14. The air check valve of claim 13 wherein the ring is adapted to be mounted relative to the fan such that the second flange is lower than the first, third and fourth flanges.

15. The air check valve of claim 11 wherein the rod defines a pivot axis that is non-parallel relative to the plane of the ring.

* * * * *